United States Patent [19]

Bailey et al.

[11] 3,933,208

[45] Jan. 20, 1976

[54] CENTRALIZER CONTROL

[75] Inventors: Edward A. Bailey, Newport; David C. Langevin, Claremont; James F. Ordway, West Lebanon, all of N.H.

[73] Assignee: Joy Manufacturing Company, Pittsburgh, Pa.

[22] Filed: May 16, 1974

[21] Appl. No.: 470,367

[52] U.S. Cl. ..... 173/1; 173/141; 308/3.9

[51] Int. Cl.[2] ..... B23Q 5/00; E21C 9/00

[58] Field of Search ..... 173/105, 141, 1; 175/85, 175/220; 308/3.9

[56] References Cited

UNITED STATES PATENTS

| | | | |
|---|---|---|---|
| 3,158,213 | 11/1964 | O'Neill et al. | 175/85 |
| 3,181,630 | 5/1965 | Coburn | 175/220 |
| 3,734,209 | 5/1973 | Haisch et al. | 175/85 |
| 3,768,663 | 10/1973 | Turner et al. | 175/85 |

*Primary Examiner*—Frank L. Abbott
*Assistant Examiner*—Richard E. Favreau

[57] ABSTRACT

An automatic control system for an adjustable, power operated drill string centralizer.

10 Claims, 4 Drawing Figures

CENTRALIZER CONTROL

Rock drill assemblies and especially rock drill assemblies which are adapted to support a drill string exceeding approximately ten feet in length typically have been provided with centralizer means on the respective guide frames thereof to transversely support the drill string at one or more points intermediate the forward end centralizer and the drill motor. Heretofore various such intermediate centralizers have been provided including a power centralizer carried by the guide frame and having a drill steel supporting arm which is adapted by fluid power means to pivot laterally out of the path of the advancing drill motor thereby permitting the drill motor to advance therepast as drilling progresses.

The fluid power control systems heretofore provided for centralizers of the type specified have not proved entirely satisfactory. For example, prior power centralizers typically have been manually operable by an operator at the drill control station, and therefore have required excessively long and cumbersome fluid flow conduit systems extending intermediate the centralizer and the controls therefor. Additionally, prior control systems have not provided fool-proof centralizer operation inasmuch as the centralizer could be accidentally actuated by the drill operator. Prior control systems have also proved unsatisfactory in that proper operation thereof depends upon the operator having an unobstructed view of the advancing drill motor which, of course, may be impossible in some drilling configurations.

The present invention remedies these and other shortcomings of prior control systems by means of an automatic control system for a fluid powered centralizer which is carried by a rock drill guide frame adjacent the centralizer controlled thereby and is operable to open or close the controlled centralizer arm in response to the position of the drill motor. The control system of this invention additionally provides a self-correcting feature which automatically remedies any movement of the centralizer arm from its proper position such as might be caused for example, by the shock loads generated during drilling operations.

These and other objects and advantages of the present invention are more fully specified in the following description and illustrations, in which.

Figure 1:
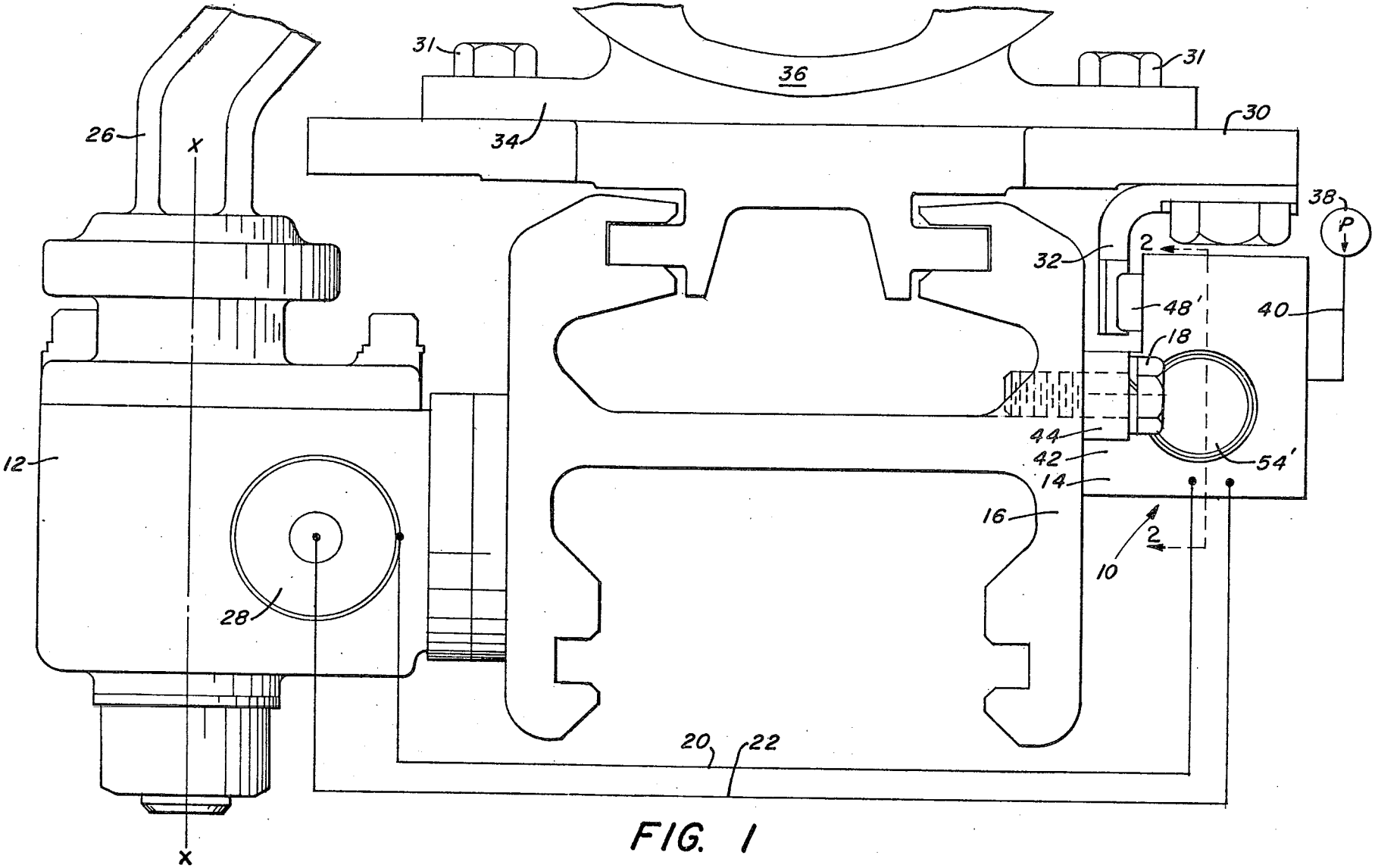
FIG. 1 illustrates partly in schematic a centralizer control system constructed in accordance with the principles of the present invention.

There is generally indicated at 10 in FIG. 1 a fluid powered centralizer control system constructed in accordance with the principles of the present invention and comprising: a control unit 14 rigidly affixed to a well known elongated rock drill guide frame 16 shown in end view in FIG. 1; a centralizer 12 which is also rigidly affixed to frame 16 and which includes a well known piston assembly 28 for actuating an adjustable arm 26 of the centralizer 12 as by means of suitable mechanical links (not shown); and fluid flow conduits 20 and 22 communicating intermediate assembly 28 and unit 14 whereby unit 14 is adapted to actuate the assembly 28 and thereby control operation of the centralizer 12. System 10 additionally includes: a suitable source of pressurized fluid flow such as a pump 38 which communicates with unit 14 via a suitable conduit 40; and actuating means shown as an inclined plane assembly 32 (FIGS. 1, 3 and 4) rigidly affixed to a drill motor mounting carriage 30 and adapted to trigger control unit 14. The carriage 30 is carried by frame 16 and is longitudinally movable with respect thereto as by well known chain or screw drive means (not shown).

Frame 16 carries a rock drilling apparatus 34 having a drill motor portion 36 rigidly mounted upon carriage 30 as by bolts 31 and additionally having an elongated drill string portion (not shown) which is drivingly engaged and supported adjacent one axial end thereof by motor 36 and transversely supported adjacent the forwardmost end of frame 16 by a well known forward centralizer (not shown) carried by the frame 16. The drilling apparatus 34 is longitudinally movable with respect to frame 16 by means of controlled movement of the carriage 30 as described hereinabove. Inasmuch as such apparatus as drilling apparatus 34 is well known in the art it is not further described herein. Applicant hereby refers to U.S. Pat. No. 3,666,024 for further detailed description of such a drilling apparatus.

The centralizer 12 is also known in the art and therefore is not described in detail herein. Suffice it to note that centralizer arm 26 has an arm portion (not shown) which extends generally transversely to the drill steel portion of apparatus 34 and is adapted to transversely engage and support the drill steel intermediate the forward centralizer and drill motor 36. During drilling operations the carriage 30, drilling apparatus 34 and assembly 32 advance forwardly along frame 16 and the drill steel is transversely supported by arm 26 as described. At a point predetermined by the location of unit 14 the assembly 32 actuates unit 14 in a manner to be described hereinbelow to operate the piston assembly 28. Assembly 28 in turn disengages arm 26 from the drill steel by pivoting arm 26 about an axis X—X (FIG. 1) laterally out of the path of the advancing motor 36 such that the motor 36 may advance therepast as drilling progresses.

Figure 2:
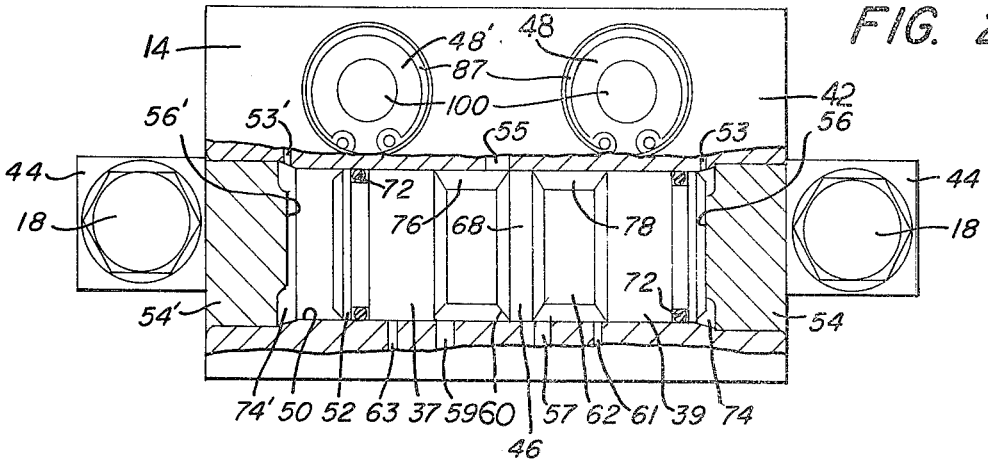
FIG. 2 illustrates partly in section the centralizer control unit of this invention substantially as seen from line 2—2 of FIG. 1.
Figure 3:
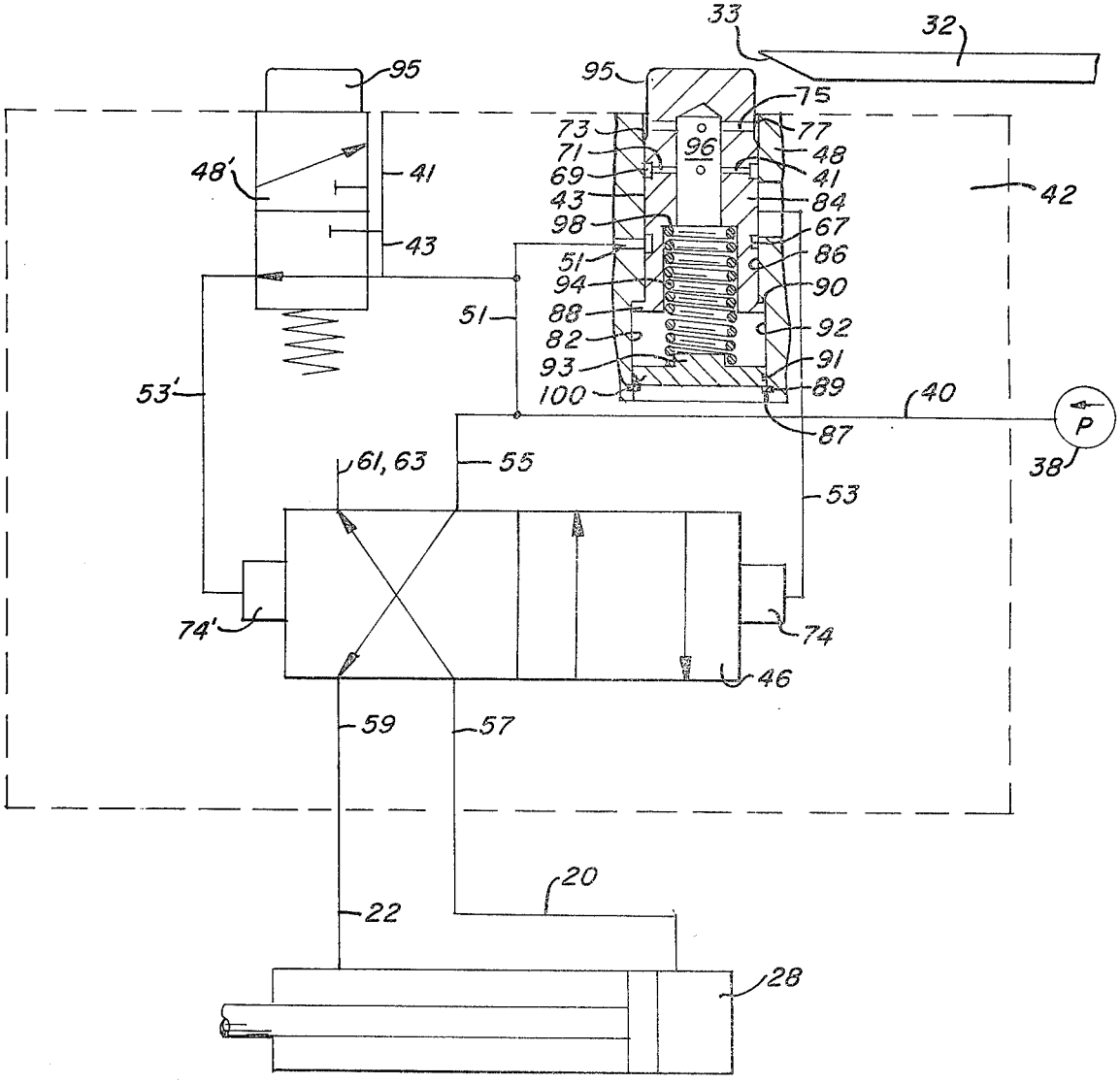
FIG. 3 illustrates partly in section and partly in schematic one selected operating position of the centralizer control unit.

It will be seen by reference to FIGS. 1, 2 and 3 that the unit 14 includes a generally rectangular body member 42 shown as having lug portions 44 adapted to receive bolts 18 for rigidly securing the unit 14 to frame 16. Unit 14 may of course be secured to frame 16 in any suitable alternative manner. The body 42 includes: a main control valve portion 46 which controls fluid flow to the assembly 28; identical pilot or actuator valve portions 48 and 48' which cooperate with the assembly 32 to actuate valve 46; and various fluid flow passages to be described hereinbelow which communicate intermediate control valve 46 and actuator valves 48 and 48'.

Control valve 46 comprises a through bore 50 which has slideably disposed therewithin a generally cylindrical valve spool or shuttle 52. A pair of cylindrical end cap members 54 and 54' are threadedly or otherwise rigidly, releasably and sealingly secured within axially opposed end portions of bore 50 to capitively retain the spool 52 therebetween such that spool 52 is slideable intermediate respective axially inward transverse end surfaces 56 and 56' of caps 54 and 54'. In FIG. 2 the spool 52 is shown in an extreme position thereof abutting the surface 56.

Spool 52 includes: radially inwardly extending circumferential groove portions 60 and 62 disposed intermediate the axial ends thereof and spaced apart by a land 68; and circumferential lands 37 and 39 extending axially intermediate respective grooves 60 and 62 and the axially adjacent end portions of shuttle 52. The grooves 60 and 62 define respective annular chambers 76 and 78 within bore 50 which are sealed from one another and from end portions of the shuttle 52 by sealing engagement of respective lands 68, 37 and 39 with the periphery of bore 50. Suitable annular seals such as O-rings 72 encompass the lands 37 and 39 radially intermediate adjacent peripheral portions of the spool 52 and bore 50 to provide additional sealing engagement therebetween whereby chambers 74 and 74' are defined within the bore 50 axially intermediate spool 52 and respective end caps 54 and 54'. The engagement of seals 72 with bore 50 additionally provides a friction resistance of sufficient magnitude to suppress sliding of the shuttle 52 and thereby maintain the position of shuttle 52 during certain stages of operation of the valve 46 as described hereinbelow.

The actuator valves 48 and 48' are spaced apart within body 42 in a direction parallel to the longitudinal extent of frame 16 and are disposed adjacent the path traversed by assembly 32. It will be understood that inasmuch as the valves 48 and 48' are identical in all respects only the valve 48 is described in detail herein and such description is equally applicable to the valve 48'.

Valve 48 comprises: a stepped through bore 82 extending within body 42; a generally cylindrical valve spool 84 slideably carried within bore 82; a disc-like spool retaining member 100 disposed coaxially within bore 82 adjacent the rearwardmost end thereof; and a helical spring 94 extending axially intermediate spool 84 and member 100. The bore 82 includes: forward and rearward bore portions 86 and 92, respectively; and a rearwardly facing annular seat portion 90 defined intermediate bore portions 86 and 92 which is engageable by a radially outwardly extending annular flange 88 formed adjacent the rearwardmost end of spool 84. Bore portion 92 sealingly retains therewithin the member 100 adjacent the rearwardmost end thereof as by a snap ring 87 disposed within an annular groove 89 outwardly adjacent the member 100 and an annular seal 91 disposed radially intermediate adjacent peripheral portions of member 100 and bore portion 92. The spring 94 extends intermediate a cylindrical seating portion 93 of member 100 and an annular seat portion 98 of a bore 96 which extends coaxially within spool 84 from the rearwardmost end thereof whereby the spring 94 is captively retained in compression intermediate member 100 and spool 84. The consequent biasing force of spring 94 urges spool 84 to a neutral or unactuated position thereof whereat flange 88 engages seat 90 and spool 84 extends forwardly therefrom through bore portion 86 and outwardly from body 42.

Spool 84 additionally includes: a cylindrical actuator button portion 95 formed adjacent the forwardmost axial end of the spool 84 and positioned suitably for engagement thereof by assembly 32; a circumferentially extending annular groove 67 disposed intermediate the axial ends of the spool 84 within bore portion 86 and adapted as a fluid inlet passage; a circumferentially extending annular groove 69 spaced forwardly from groove 67 within bore portion 86 and adapted as a fluid exhaust passage; a plurality of circumferentially spaced, radially extending bores 71 which communicate intermediate the groove 69 and bore 96; a forwardly open annulus 73 formed forwardly of the groove 69 adjacent the base of button 95; an annular passage 77 defined intermediate radially adjacent peripheral portions of spool 84 and bore portion 86 and axially communicating intermediate the annulus 73 and the atmosphere; a plurality of circumferentially spaced radially extending bores 75 which communicate intermediate passage 77 and bore 96; and a fluid exhaust passage 41 which includes in order the groove 69, bores 71, bore 96, bores 75 and the passage 77 and which provides an exhaust fluid flow path from groove 69 to the atmosphere. The passage 41 is illustrated schematically in FIGS. 3 and 4. Additionally, a cleansing or purging flow passage is defined which comprises a controlled leakage clearance path 43 communicating longitudinally over the periphery of spool 84 intermediate grooves 67 and 69, and the passage 41 described hereinabove.

As illustrated schematically in FIG. 3 passageway means communicating with control valve 46 and valves 48 and 48' are provided within body 42 including: a pressure inlet passage 51 which communicates intermediate conduit 40 and the valve 48 and 48'; a pair of flow passages 53 and 53' which communicate intermediate respective valves 48 and 48' and respective chambers 74 and 74' of valve 46; a fluid supply port 55 which communicates intermediate conduit 40 and the control valve 46; other fluid supply ports 57 and 59 which communicate intermediate control valve 46 and conduits 20 and 22, respectively, and exhaust ports 61 and 63 which communicate intermediate control valve 46 and the atmosphere.

Operation of the control system is now described with reference to FIGS. 3 and 4. FIG. 3 illustrates the control system of this invention a moment prior to initial actuation thereof by the advancing assembly 32 which, it is to be understood, moves from right to left as viewed in FIG. 3 during ongoing drilling operations. As shown in FIG. 3 valves 48 and 48' are in the neutral position whereat grooves 67 register with and provide open communication between passages 51 and 53. The pump 38 is directing fluid flow via conduit 40 and passages 51 to valves 48 and 48', and thence via grooves 67 and passages 53 and 53' to respective chambers 74 and 74' whereby equal and opposing pressures are exerted on axially opposed ends of the shuttle 52. Inasmuch as no net axial pressure component is acting on shuttle 52 the O-rings 72 maintain the shuttle 52 in abutment with surface 56 (FIG. 2) whereby pump 38 directs a flow of pressurized fluid via conduit 40, passage 55, chamber 76, passage 59 and conduit 22 to one side of piston assembly 28. The opposite side of assembly 28 is vented to the atmosphere via conduit 20, passage 57, chamber 78 and passage 61, and the assembly 28 is thus maintained in one extreme position thereof, that shown as being the fully retracted position, whereby arm 26 is maintained in the fully closed or engaged position to transversely support the drill string in the customary manner.

A portion of the fluid flow from pump 38 to valves 48 and 48' is directed as a metered purge flow via passages 43 and 41 to the atmosphere. In passages 41 the plurality of bores 75 distributes the purge fluid uniformly within passage 77 thereby producing a cleansing or purging action which precludes accumulation of dirt or debris that might otherwise jam the valves 48 and 48'.

Inasmuch as the flow area of passage 43 is relatively small, the purging action described requires only an insignificant portion the total flow capacity available from pump 38.

As the carriage 30 advances from the position illustrated in FIG. 3 an inclined plane portion 33 of assembly 32 engages button 95 of valve 48 thereby urging the spool 84 downwardly as viewed in FIG. 3 against the upward biasing force of spring 94. The consequent downward shifting of spool 84 moves groove 67 out of register with pressure inlet 51 and passage 53, and moves groove 69 into register with passage 53. The pressure in chamber 74 is thus vented to the atmosphere via the passages 53 and 41, and the pressure in chamber 74' maintains shuttle 52 in abutment with surface 56 as illustrated in FIG. 2. It is of course to be understood that purge flow via passages 51, 43 and 41 is continuous and is not affected by shifting of the spool 84.

As carriage 30 continues advancing, the assembly 32 maintains valve 48 in the shifted or actuated position and engages button 95 of valve 48' thereby urging the spool 84 thereof downwardly in a like manner as hereinabove described for valve 48, and in response thereto the pressure in chamber 74' is vented to the atmosphere via passages 53' and passage 41 of the valve 48'. As in the case of the valve 48, the purge flow in valve 48' is continuous and is unaffected by valve actuation. The venting of pressure from chamber 74' once again equalizes the fluid pressure in chambers 74 and 74' such that only the friction resistance of O-ring seals 72 maintains the position of shuttle 52 in abutment with surface 56.

Figure 4:
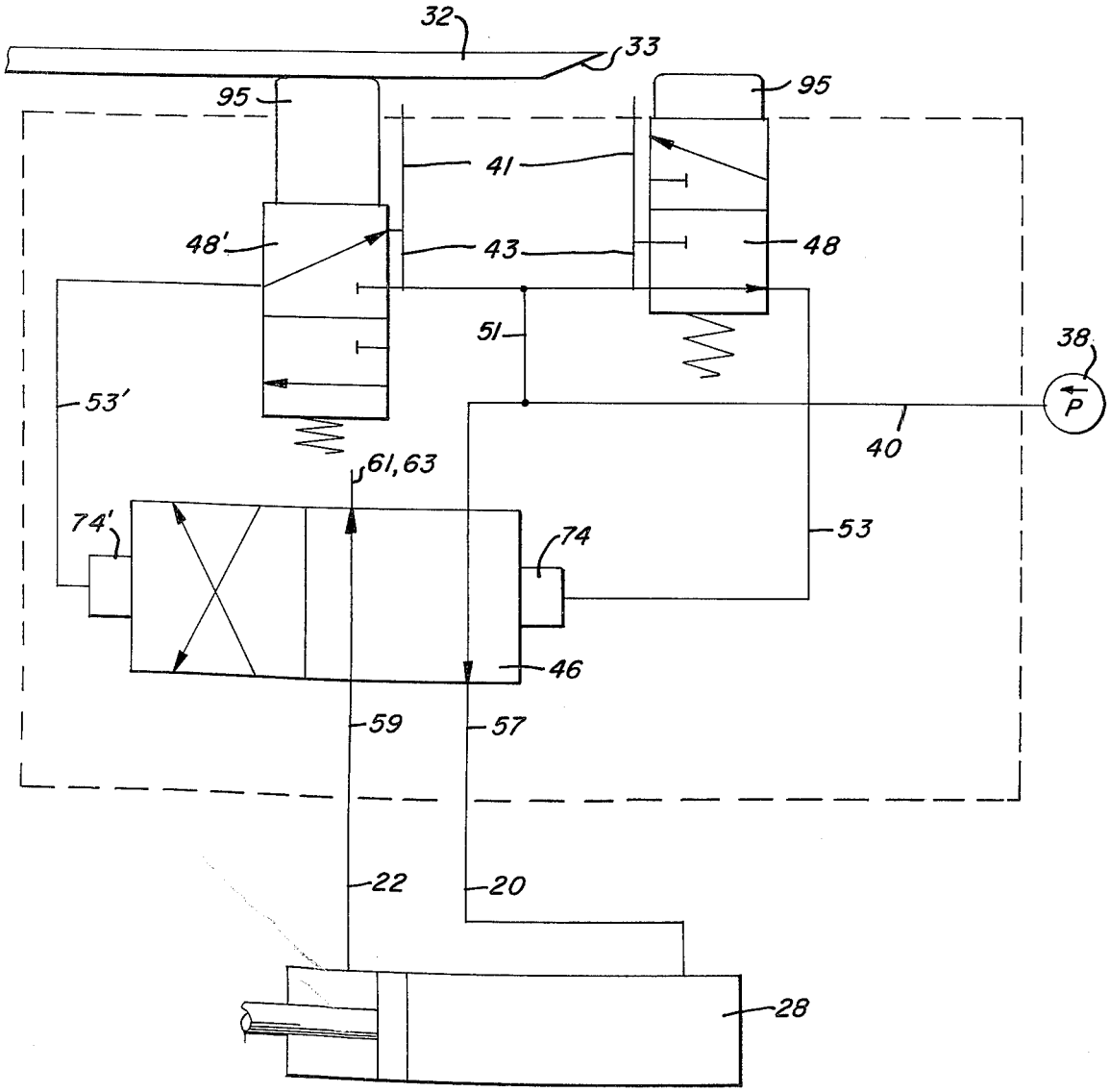
FIG. 4 illustrates in schematic another operating position of the centralizer control unit.

By reference to FIG. 4 it will be seen that in response to continued advancing of carriage 30 the assembly 32 disengages button 95 of valve 48 thereby permitting spool 84 thereof to be returned to its neutral position under the impetus of spring 94 whereby groove 67 is moved into register with passages 51 and 53 and groove 69 moves out of register with passage 53. Accordingly, pressurized fluid flow from pump 38 is once again directed via conduit 40, passage 51, groove 67 and passage 53 into chamber 74 and in response thereto shuttle 52 is urged toward the left and into abutment with surface 56'. The shift of shuttle 52 initiates fluid flow to the rearward side of assembly 28 via a path through passage 55, chamber 78, passage 57 and conduit 20, and provides an exhaust path to the atmosphere from the forward side of assembly 28 via a path through conduit 22, passage 59, chamber 76 and passage 63 whereby the assembly 28 is urged toward the fully extended position to open or disengage arm 26 and permit the carriages 30 and drilling apparatus 34 to advance therepast as drilling continues.

As carriage 30 continues advancing, the valve 48' is disengaged by assembly 32 in a like manner as described for valve 48 whereby pressurized fluid flow is directed to chamber 74' to once again equalize the fluid pressures in chambers 74 and 74'. The shuttle 52 is thus maintained in the position shown schematically in FIG. 4 by the friction resistance of seals 72 as described hereinabove and fluid pressure is continuously directed to the rearward side of assembly 28 to maintain the arm 26 in the open position thereof.

During retraction of the apparatus 34 after completion of a drilling operation the assembly 32 will engage valves 48' and 48 in that order and in the manner previously described to close or reengage the arm 26. During drill retraction the assembly 32 first engages valve 48' thereby venting pressure in chamber 74' to the atmosphere as hereinabove described. Next assembly 32 engages valve 48 thereby venting the pressure in chamber 74 to the atmosphere. Subsequently the assembly 32 disengages valve 48' thereby restoring fluid pressure to the chamber 74' to urge the shuttle 52 into abutment with surface 56. In response thereto pressurized fluid is directed to the front of assembly 28 to close or reengage arm 26 and the rearward side of assembly 28 is vented to the atmosphere. Finally the assembly 32 disengages valve 48 thereby directing fluid pressure to the chamber 74 to once again equalize pressures on opposite sides of the shuttle 52. After retraction of apparatus 34, the arm 26 will remain engaged with the drill string for transverse support thereof until disengaged once again as described hereinabove during a subsequent drilling operation.

It is to be noted that at all times during system operation a fluid pressure is being exerted on one side or the other of the piston in assembly 28 whereby a positive, self correcting force is provided at all times to counteract and correct irregular movement of the arm 26 which may be caused for example by inertial loads generated during drilling operations.

By virtue of the structure described hereinabove a fool-proof, automatic fluid powered centralizer control system is provided wherein two actuator valves which are operable sequentially by the advancing or retracting of a movable drilling apparatus along a guide frame cooperate to control a main valve which in turn controls the position of a pivotal centralizer arm through a fluid actuated piston assembly. The control system of the present invention provides a novel cleansing or purging means to avoid fouling or jamming of the actuator valves by airborne debris generated during drilling operations, and additionally provides a self-correcting feature to counteract spurious or irregular centralizer arm movement.

Notwithstanding the reference hereinabove to a specific embodiment of the present invention, it will be clear to those versed in the art that this invention may be modified in various ways without departing from the broad spirit and scope thereof. For example, it is contemplated that this control system could be adapted for use with a variety of centralizers including longitudinally movable centralizers or swinging drop type centralizers; a single control system of the type described could be adapted to control a plurality of powered centralizers; assembly 32 and the positioning relative thereto of valves 48 and 48' may take numerous configurations; and the like.

These and other modifications having been envisioned and anticipated it is requested that the present invention be interpreted broadly and limited only by the scope of the claims appended hereto.

What is claimed is:

1. A drill string centralizer assembly, of a type adapted to be mounted on an elongated boom having a drilling motor assembly longitudinally reciprocable therealong, comprising: centralizer means adapted to be mounted on such boom and having a movable portion movable between a drill string support position and drill motor assembly pass position; actuator means adapted to be mounted on such a boom at a location intermediate the ends thereof and in a position to be engaged and subsequently disengaged by such drill motor assembly during the reciprocable movement thereof; said actuator means being cooperable with said centralizer means to cause said movable portion to be moved to said support position in response to the engagement and subsequent disengagement of said actuator means by such drill motor assembly moving thereby in one direction along such boom and to cause said movable portion to be moved to said pass position in response to the engagement and subsequent disengagement of said actuator means by such drill motor assembly moving thereby in the opposite direction along such boom.

2. A centralizer assembly as specified in claim 1 wherein: said actuator means includes two control members longitudinally spaced along such boom at said location; said movable portion being moved in response to the relative order in which said control members are engaged and subsequently disengaged by such drill motor assembly.

3. A centralizer assembly as specified in claim 2 wherein: said control members are fluid control valves, engagement of either of said valves by such drill motor assembly causing the respective valve to assume one operating position and disengagement of either of said valves causing the respective valve to assume another operating position.

4. A centralizer assembly as specified in claim 3 additionally comprising: a main fluid valve in fluid communication with said fluid control valve and in fluid communication with said movable portion wherein the sequence in which said fluid control valves are engaged and subsequently disengaged causes said main fluid valve to assume a predetermined operating position.

5. A centralizer assembly as specified in claim 4 wherein the operating position of said main fluid valve determines the position of said movable portion.

6. A method of controlling a drill string centralizer of a drilling machine which includes an elongated boom, a drill motor assembly longitudinally reciprocable along said boom and a centralizer actuator means mounted on said boom at a location adjacent the path of reciprocable movement of said drill motor assembly and intermediate the axial ends of said boom, comprising the steps of: moving said drill motor assembly along said path in one direction from one end portion of said boom toward the opposite end portion thereof; positioning a portion of said centralizer into a drill string support position in response to at least a portion of said drill motor assembly passing said location on said boom; maintaining said portion of said centralizer in said support position as said drill motor assembly moves past said location in said one direction and until said drill motor assembly passes said location during the return movement thereof; moving said drill motor assembly along said path in an opposite direction from said opposite end portion toward said one end portion; positioning said portion of said centralizer into a drill motor assembly pass position in response to at least a portion of said drill motor assembly passing said location during said last mentioned moving; maintaining said centralizer portion in said pass position as said drill motor assembly moves past said location in said opposite direction and until said drill motor assembly passes said location during return.

7. The method as specified in claim 6 wherein said first and last mentioned positioning is accomplished by engagement and subsequent disengagement between said at least a portion of said drill motor assembly and said actuator means.

8. The method as specified in claim 7 wherein said first and last mentioned maintaining is accomplished by applying a continuous force to said centralizer portion.

9. The method as specified in claim 8 wherein application of said force is by a fluid pressure acting upon a surface of said portion of said centralizer.

10. The method as specified in claim 9 wherein said application of said force is controlled by a main fluid control valve which is controlled by said actuator means.

* * * * *